US008583011B2

(12) United States Patent
Miyaji et al.

(10) Patent No.: US 8,583,011 B2
(45) Date of Patent: Nov. 12, 2013

(54) IMAGE FORMING APPARATUS HAVING A POSITIVELY CHARGED SINGLE LAYER TYPE ELECTROPHOTOGRAPHIC PHOTORECEPTOR

(75) Inventors: Shinki Miyaji, Osaka (JP); Masaki Kadota, Osaka (JP); Yoshitaka Imanaka, Osaka (JP); Hiroka Itani, Osaka (JP); Masahito Ishino, Osaka (JP)

(73) Assignee: Kyocera Mita Corporation (JP)

( * ) Notice: Subject to any disclaimer, the term of this patent is extended or adjusted under 35 U.S.C. 154(b) by 68 days.

(21) Appl. No.: 13/150,329

(22) Filed: Jun. 1, 2011

(65) Prior Publication Data

US 2011/0299887 A1 Dec. 8, 2011

(30) Foreign Application Priority Data

Jun. 4, 2010 (JP) ..... 2010-129123
Dec. 27, 2010 (JP) ..... 2010-289757

(51) Int. Cl.
*G03G 15/00* (2006.01)
*G03G 15/02* (2006.01)

(52) U.S. Cl.
USPC ..... 399/159; 399/176; 399/168

(58) Field of Classification Search
USPC ..... 399/159, 176, 168
See application file for complete search history.

(56) References Cited

U.S. PATENT DOCUMENTS

| | | | | |
|---|---|---|---|---|
| 5,382,489 | A * | 1/1995 | Ojima et al. | 430/96 |
| 2002/0045119 | A1 | 4/2002 | Azuma et al. | |
| 2006/0166117 | A1* | 7/2006 | Azuma et al. | 430/74 |
| 2010/0135695 | A1* | 6/2010 | Mayuzumi et al. | 399/111 |

FOREIGN PATENT DOCUMENTS

| | | |
|---|---|---|
| JP | 5-303259 | 11/1993 |
| JP | 2002-72511 | 3/2002 |
| JP | 2003-316111 | 11/2003 |
| JP | 2004-133067 | 4/2004 |
| JP | 2007-187814 | 7/2007 |
| JP | 2007-271731 | 10/2007 |
| JP | 2008-164960 | 7/2008 |
| JP | 2010-107769 | 5/2010 |

* cited by examiner

*Primary Examiner* — Billy J Lactaoen
(74) *Attorney, Agent, or Firm* — Gerald E. Hespos; Michael J. Porco; Matthew T. Hespos

(57) ABSTRACT

An image forming apparatus includes a positively-charged single layer type electrophotographic photoreceptor, a charging device with a contact charging roller for charging a surface of the photoreceptor and an exposure device for exposing the charged surface of the photoreceptor to light to form an electrostatic latent image thereon. A developing device develops the electrostatic latent image into a toner image and a transfer device transfers the toner image to a transferred body. The charging roller is made of electrically conductive rubber having an Asker-C rubber hardness of 62 to 81°. A roller surface roughness of the charging roller has an average distance (Sm) between asperity peaks on a cross-sectional curve of 55 to 130 μm and that a ten-point average roughness (Rz) is 9 to 19 μm. The image forming apparatus is capable of preventing carrier trapping, film peeling and uneven charging in the photoreceptor.

2 Claims, 7 Drawing Sheets

IMAGE FORMING APPARATUS HAVING A POSITIVELY CHARGED SINGLE LAYER TYPE ELECTROPHOTOGRAPHIC PHOTORECEPTOR

BACKGROUND OF THE INVENTION

1. Field of the Invention

The present invention relates to an image forming apparatus that has a positively-charged single layer type electrophotographic photoreceptor and a contact charging member.

2. Description of the Related Art

In consideration of the environment, most of the electrophotographic image forming apparatuses of recent years use the scorotron charging system (non-contact system) that forms a large amount of ozone and a contact charging system that performs roller charging using, for example, a rubber roller. The roller charging where electricity is discharged in a small gap between a photoreceptor and a roller realizes a reduction of the ozone.

Inorganic photoreceptors and organic photoreceptors are used as electrophotographic photoreceptors of the electrophotographic image forming apparatuses. Compared to the inorganic photoreceptors, the organic photoreceptors can be produced easily and have a high degree of freedom in the structural design thereof due to a wide selection of organic materials constituting photosensitive layers.

Examples of the organic photoreceptors include a multilayered photoreceptor, which is obtained by laminating a charge generating layer containing a charge generating agent and a charge transport layer containing a charge transport agent, and a single layer type photoreceptor, which has a photosensitive layer containing the charge generating agent and the charge transport agent together. Especially the single layer type photoreceptor is designed to last long, because its film thickness can be increased by a carrier generated near its surface. In addition, compared to the multilayered photoreceptor, the single layer type photoreceptor can be produced more easily at a lower cost with a single layer coating process.

For this reason, a combination of such single layer type photoreceptor and the roller charging is considered to be able to accomplish an environmentally responsive electrophotographic design.

However, a problem specific to a charging roller is the occurrence of uneven charging, which takes place when electricity is discharged locally from an uneven surface of the charging roller. The uneven charging tends to occur in a positively-charged single layer type photoreceptor. Although the specific reason for the uneven charging is unknown, a possible reason thereof is that the discharged voltages vary according to the materials contained in the same resin layer of the single layer type photoreceptor, which are a charge generating material, charge transport material, and binder resin, thereby causing the local discharge.

Although there is a technique for preventing the local discharge, which is a cause of the uneven charging, by increasing the discharge voltage so that the electricity can be discharged from a section that is unlikely to discharge electricity, increasing the discharge voltage (=influx current to the photoreceptor) facilitates peeling of the film of the photoreceptor, thus reducing the life-span of the photoreceptor. For this reason, a technique for preventing the uneven charging without increasing the charged voltage is required.

In addition, unlike the multilayered photoreceptor in which the charge generating layer and the charge transport layer are separated from each other, the single layer type photoreceptor has a composition of a resin material, which is the main ingredient of a photoconductive layer, and a number of materials such as the charge generating material and charge transport material. According to such a configuration, a photocarrier is considered to pass through these various materials in the single layer type photoreceptor and trap these materials (FIG. 1). This carrier trapping changes the characteristics of the photoreceptor and reduces the charging ability of the photoreceptor (indicated by the charge potential of a photoreceptor drum, which is obtained when a constant current is applied thereto).

When the charging ability of the photoreceptor becomes low, the surface potential of the photoreceptor becomes low as well. The electrification current needs to be increased in order to obtain a predetermined surface potential. However, increasing the electrification current means increasing the amount of electric discharge, which causes a negative effect where the film of the photosensitive layer peels off.

The present invention was contrived in view of these circumstances, and an object thereof is to provide an environmentally responsive image forming apparatus having a single layer type photoreceptor and charging roller, the image forming apparatus being capable of preventing the carrier trapping, film peeling and uneven charging that occur on a photosensitive layer.

SUMMARY OF THE INVENTION

As a result of the earnest research, the inventors of the present invention have discovered that the object described above can be accomplished by using the following image forming apparatus, and completed the present invention after a great deal of research based on such discovery.

An image forming apparatus according to one aspect of the present invention is an image forming apparatus that has: a positively-charged single layer type electrophotographic photoreceptor; a charging device that has a contact charging member for charging a surface of the photoreceptor; an exposure device for exposing the charged surface of the photoreceptor to light to form an electrostatic latent image on the surface of the photoreceptor; a developing device for developing the electrostatic latent image into a toner image; and a transfer device for transferring the toner image from the photoreceptor to a transferred body, wherein the contact charging member is a charging roller, which is made of electrically conductive rubber having an Asker-C rubber hardness of 62 to 81°, and a roller surface roughness of the charging roller of the contact charging member is such that an average distance (Sm) between asperity peaks on a cross-sectional curve is 55 to 130 μm and that a ten-point average roughness (Rz) is 9 to 19 μm.

Further objects and specific advantages provided by the present invention will be clarified by the following descriptions of embodiments.

DETAILED DESCRIPTION OF THE PREFERRED EMBODIMENTS

Figure 1:
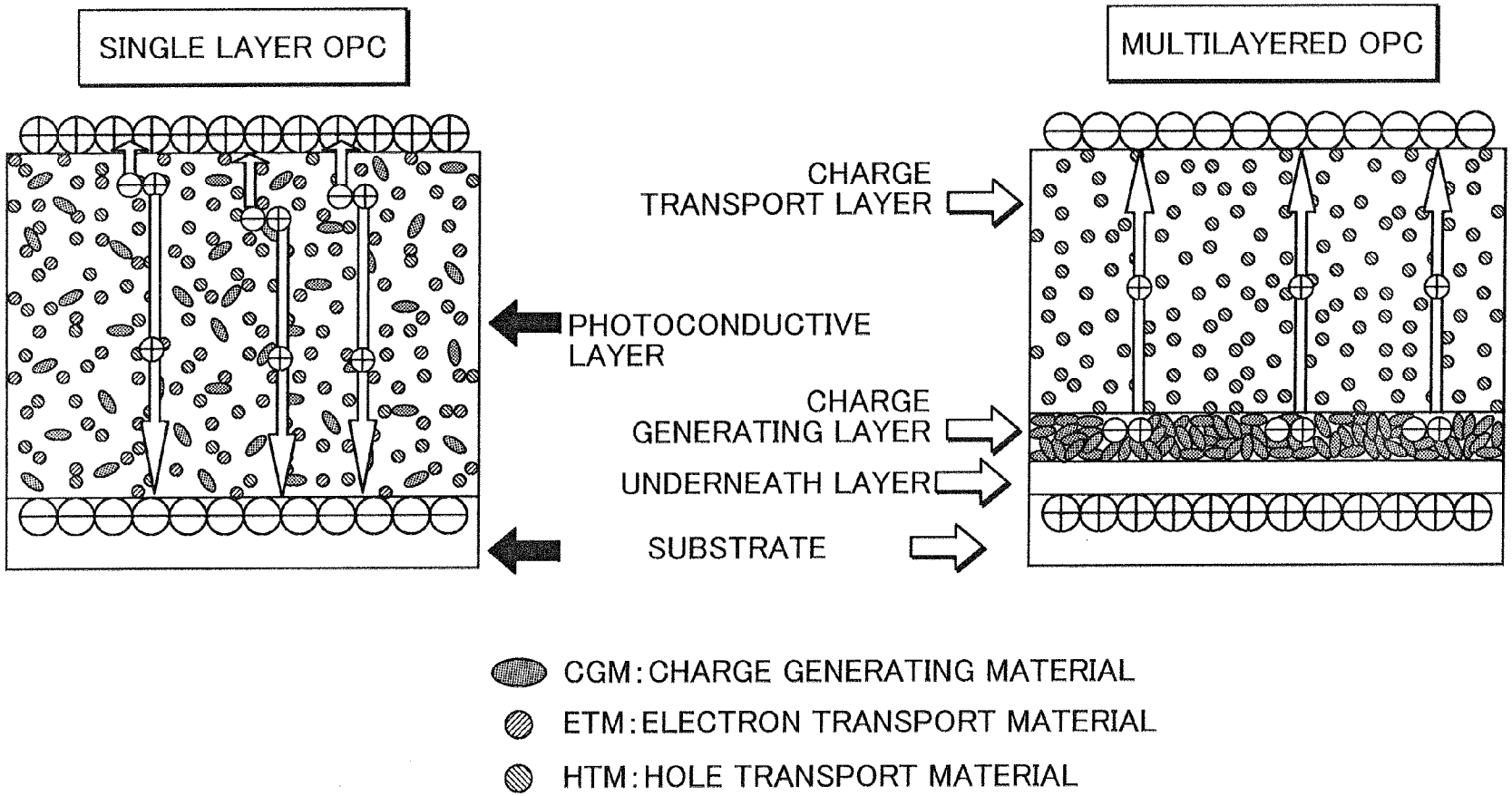
FIG. 1 is a schematic cross-sectional diagram showing carrier trapping in a single layer type photoreceptor and multilayered photoreceptor.

Embodiments of the present invention are now described hereinafter, but the present invention is not limited thereto.

[Image Forming Apparatus]

An image forming apparatus according to the present embodiment is an image forming apparatus that has: a positively-charged single layer type electrophotographic photoreceptor; a charging device that has a contact charging member for charging a surface of the photoreceptor; an exposure device for exposing the charged surface of the photoreceptor to light to form an electrostatic latent image on the surface of the photoreceptor; a developing device for developing the electrostatic latent image into a toner image; and a transfer device for transferring the toner image from the photoreceptor to a transferred body. The basic configuration of this image forming apparatus is that the contact charging member is a charging roller in which at least a surface part thereof is made of electrically conductive rubber having an Asker-C rubber hardness of 62 to 81° and a roller surface roughness thereof is such that an average distance (Sm) between asperity peaks on a cross-sectional curve is 55 to 130 μm and that a ten-point average roughness (Rz) is 9 to 19 μm.

Such a configuration is considered to be able to adequately prevent uneven charging as well as the occurrence of peeling of a film of the photoreceptor. Furthermore, proximity discharge regions that are generated in a nip between a photoreceptor drum and the charging roller and the periphery thereof can be enlarged, improving the charging performance of the photoreceptor. Therefore, unlike conventional charging rollers, this configuration can eliminate carrier trapping within a photosensitive layer, thus stabilizing the characteristics of the photoreceptor drum and preventing the reduction of a surface potential and film peeling.

(Charging Device)

The charging device used in the present embodiment has the contact charging member for charging a surface of the photoreceptor. As the contact charging member, the present embodiment uses a contact charging roller (rubber roller), which is made of electrically conductive rubber having an Asker-C rubber hardness of 62 to 81°, and a roller surface roughness of which is such that an average distance (Sm) between asperity peaks on a cross-sectional curve is 55 to 130 μm and that a ten-point average roughness (Rz) is 9 to 19 μm. This charging roller is rotated by the rotation of the photoreceptor drum while contacting the photoreceptor drum, so as to charge a circumferential surface (surface) of the photoreceptor drum.

Specific configurations of the charging roller are not particularly limited; however, examples of the charging roller include the one that has a cored bar supported rotatably, an electrically conductive rubber layer formed on a surface part thereof (i.e., on the cored bar), and voltage application means for applying a voltage to the cored bar. With the application of a voltage from the voltage application means to the cored bar, the charging device with such a charging roller can charge the surface of the photoreceptor drum that is in contact with the charging roller via the electrically conductive rubber layer.

The thickness of the electrically conductive rubber layer of the charging roller is not particularly limited but is normally 0.5 to 2.0 mm and preferably 1.0 to 2.0 mm.

As long as the Asker-C rubber hardness is within the range of 62 to 81°, electrically conductive rubber materials are not limited to the one used in the charging roller of the present embodiment. A more preferred range of rubber hardness is 65 to 75°. An Asker-C rubber hardness exceeding 81° tends to cause uneven charging and facilitates peeling of the film of the photoreceptor. An Asker-C rubber hardness of less than 62° cannot obtain uniform chargeability enough for the contact charging device (charging roller) to function. It should be noted that the rubber hardness can be measured using a known method, such as a method described in the following examples.

Specific examples of the rubber material include epichlorohydrin rubber, urethane rubber, silicon rubber, nitrile rubber (NBR), and CR rubber. Above all, epichlorohydrin rubber and nitrile rubber (NBR) are preferably used as electrically conductive rubber due to their resistance to ozone, low-temperature characteristics and electric conductive uniformity (the difference in resistance is small depending on places).

By using such a charging roller, the proximity discharge regions that are generated in the nip between the photoreceptor drum and the charging roller and the periphery thereof can be enlarged, improving the charging performance of the photoreceptor. Therefore, unlike conventional charging rollers, this configuration can eliminate carrier trapping within the photosensitive layer, thus stabilizing the characteristics of the photoreceptor drum and preventing the reduction of a surface potential and film peeling.

In addition, in the present embodiment, the roller surface roughness of the charging roller is such that the average distance (Sm) between asperity peaks on a cross-sectional curve is 55 to 130 μm and that the ten-point average roughness (Rz) is 9 to 19 μm. Such a configuration can adequately prevent uneven charging as well as the occurrence of peeling of the film of the photoreceptor. More preferably, the surface roughness of the charging roller used in the present embodiment is such that the average distance (Sm) between asperity peaks on a cross-sectional curve is preferably 70 to 100 μm and that the ten-point average roughness (Rz) is 10 to 15 μm, in terms of facilitating production control and achieving the abovementioned effects more easily. It should be noted that the average distance (Sm) between asperity peaks on a cross-sectional curve and the ten-point average roughness (Rz) can be measured using a known method, such as a method described in the following examples.

The voltage applied by the voltage application means is preferably a DC voltage, so that the photosensitive layer can be made more resistant even when the positively-charged single layer type electrophotographic photoreceptor, described hereinafter, is used. More specifically, compared to when applying the charging roller with a superimposed voltage in which an AC voltage is superimposed on an AC voltage or DC voltage, applying the charging roller only with a DC voltage can make the photosensitive layer more resistant.

Although the application of an AC voltage can uniform the potential of the surface (circumferential surface) of an image carrier by charging the surface of the image carrier, the image forming apparatus uses the contact charging device in place of a non-contact charging device so as to be able to charge the surface of the image carrier evenly with the application of a DC current alone.

Therefore, the image forming apparatus can not only form excellent images by applying only a DC current to the charging roller, but also make the photosensitive layer more resistant.

(Photoreceptor)

The positively-charged single layer type electrophotographic photoreceptor (simply referred to as "photoreceptor" or "single layer type photoreceptor," hereinafter) used in the present embodiment is not particularly limited as long as it can be suitably applied to an image forming apparatus having a contact charging device, such as the one described above.

Figure 2A:
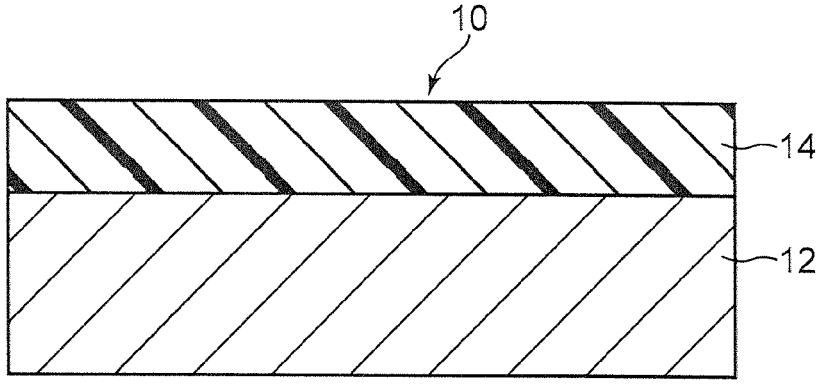
FIG. 2A to 2C are schematic cross-sectional diagrams showing a structure of a positively-charged single layer type electrophotographic photoreceptor according to an embodiment of the present invention.
Figure 2B:
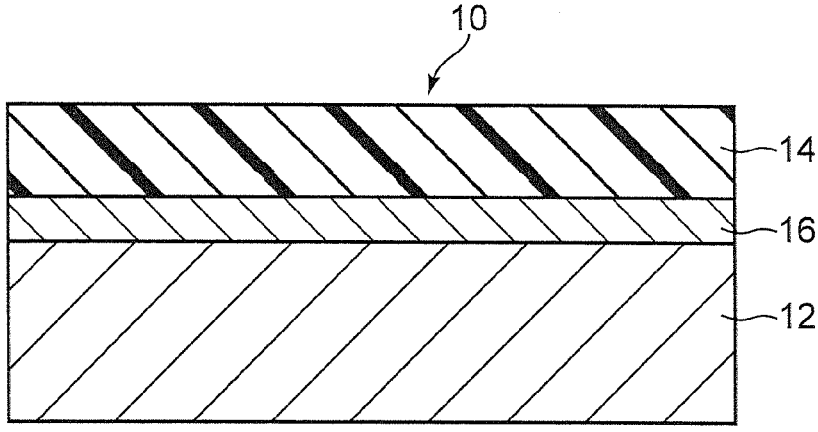
Figure 2C:
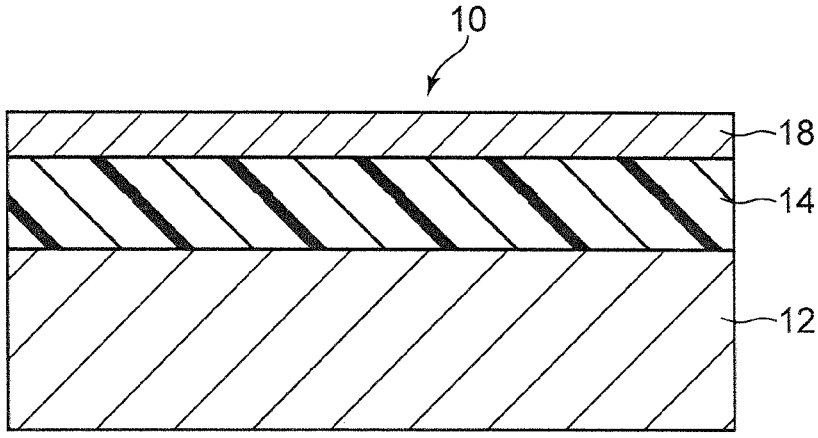

More specifically, the photoreceptor may be, for example, a single layer type photoreceptor 10 that has a conductive substrate 12 and photosensitive layer 14, wherein the photosensitive layer 14 contains a charge generating agent, charge transport agent and binder resin together therein, as shown in FIGS. 2A to 2C. The single layer type photoreceptor 10 may have additional layers other than the photosensitive layer and the conductive substrate.

For instance, as shown in FIG. 2A, the photosensitive layer 14 may be provided directly on the conductive substrate 12, or, as shown in FIG. 2B, an interlayer 16 may be provided between the conductive substrate 12 and the photosensitive layer 14. In addition, as shown in FIGS. 2A and 2B, the photosensitive layer 14 may be exposed as an outermost layer, or, as shown in FIG. 2C, a protective layer 18 may be provided on the photosensitive layer 14.

As described above, although not particularly limited, it is preferred that the single layer type photoreceptor 10 have the interlayer 16 between the conductive substrate 12 and the photosensitive layer 14 as shown in FIG. 2B, wherein the interlayer 16 is a high-resistivity layer with a resistance value higher than that of the conductive substrate 12. Such a configuration can prevent the occurrence of current leakage from the charging roller of the charging device, which is likely to occur when the film of the photoreceptor becomes thin due to prolonged use thereof.

The high-resistivity layer is not particularly limited as long as it has a resistance value higher than that of the conductive substrate 12 and is capable of preventing the occurrence of the leakage. Examples of the high-resistivity layer include an alumite layer, aluminum iodide film, tin oxide film, indium oxide film, and titanium oxide film.

The thickness of the high-resistivity layer is preferably, for example, 1 to 3 μm, depending on the material and the like of the high-resistivity layer.

It is preferred to use the photoreceptor in which the binder resin contained in the photosensitive layer has a yield point strain of 9 to 29% (or a photoreceptor surface layer has a yield point strain of 5 to 25%). Accordingly, the peeling of the film of the photoreceptor can be prevented reliably. Therefore, a combination of such a photoreceptor and the charging roller described above can reliably obtain a highly durably image forming apparatus.

The yield point strain is described next. Two sample materials are fixed to each other at their ends by using two zippers. The samples are stretched by moving one of the zippers at a constant speed, to detect stress. When illustrating a stress-strain relationship using a curve, the strain and the stress are in a proportionate relationship, in which the samples become loose due to viscous components thereof as the strain increases, thereby obtaining a maximal value of the stress. This point is the yield point. The yield point strain is a value representing the degree of the strain on each sample at the yield point. In the present embodiment, the yield point can be measured by a known method, such as a viscoelasticity measuring device, which is described in the examples hereinafter.

The conductive substrate and the photosensitive layer of the positively-charged single layer type electrophotographic photoreceptor according to the present embodiment is described hereinafter in detail.

[Conductive Substrate]

The conductive substrate is not particularly limited as long as it can be used as a conductive substrate of an electrophotographic photoreceptor. In other words, the conductive substrate can be, for example, the one in which at least a surface part is made of an electrically conductive material. More specifically, for example, the conductive substrate may be made of an electrically conductive material or obtained by coating a plastic surface with an electrically conductive material. Examples of the electrically conductive material include aluminum, iron, copper, tin, platinum, silver, vanadium, molybdenum, chromium, cadmium, titanium, nickel, palladium, indium, stainless steel, and brass. As the electrically conductive material, at least one of the abovementioned electrically conductive materials may be used, or alloy with a combination of two or more of the abovementioned electrically conductive materials may be used. It is preferred that the conductive substrate be made of aluminum or aluminum alloy, so that a photoreceptor capable of forming excellent images can be provided. This is because a charge can be moved well from the photosensitive layer to the conductive substrate.

The shape of the conductive substrate is not particularly limited. In other words, the conductive substrate may be in the form of a sheet or a drum. Specifically, the conductive substrate may be in the form of a sheet or a drum in accordance with the structure of the image forming apparatus to which the conductive substrate is applied.

[Photosensitive Layer]

The photosensitive layer used in the present embodiment can be used as a photosensitive layer of a single layer type electrophotographic photoreceptor. This photosensitive layer contains a charge generating agent, charge transport agent and binder resin, as described above. Specific examples of a structure of the photosensitive layer include the structure of the photosensitive layer shown in FIGS. 2A to 2C, as described earlier.

The charge generating agent, the charge transport agent and the binder resin contained in the photosensitive layer are not particularly limited, but the following examples can be used.

(Charge Generating Agent)

The charge generating agent is not particularly limited as long as it can be used as a charge generating agent of a single layer type electrophotographic photoreceptor. Specific examples of the charge generating agent include X-type phthalocyanine (x-H2Pc) expressed by the following formula (1) or (2), Y-type oxo-titanyl phthalocyanine (Y—TiOPc), a perylene pigment, a bis-azo pigment, a dithioketo-pyrrolo-pyrrole pigment, a metal-free naphthalocyanine pigment, a metal naphthalocyanine pigment, a squaraine pigment, a tris-azo pigment, an indigo pigment, an azlenium pigment, a cyanine pigment, inorganic photoconductive powders such as selenium, selenium-tellurium, selenium-arsenic, cadmium sulfide and amorphous silicon, pyrylium salt, an anthanthrone pigment, a triphenylmethane pigment, a threne pigment, a toluidine pigment, a pyrazoline pigment, and a quinacridone pigment.

[Chemical formula 1]

(1)

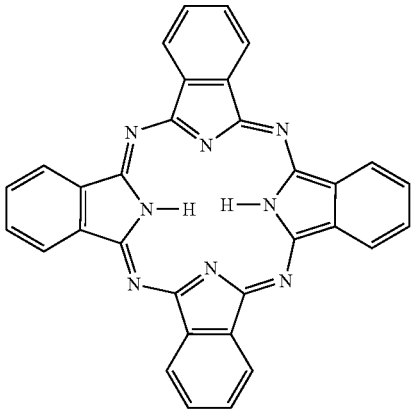

CGM-2

[Chemical formula 2]

(2)

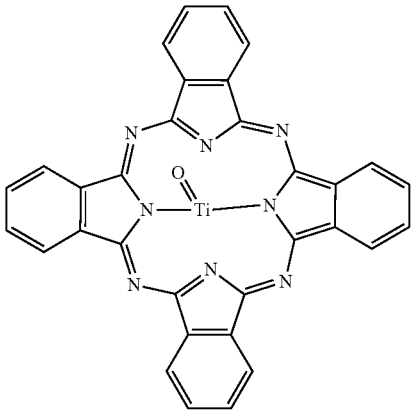

CGM-1

Each of these charge generating agents described above may be used alone, or a combination of two or more of these charge generating agents may be used, so as to provide an absorption wavelength in a desired region. Digital optical image forming apparatuses such as a laser beam printer that uses a semiconductor laser as a light source and a fax machine need a photoreceptor that has a sensitivity in at least 700 nm wavelength region, and therefore a phthalocyanine pigment, such as a metal-free naphthalocyanine or oxo-titanyl phthalocyanine, is suitably applied thereto. Note that the crystal forms of the phthalocyanine pigments are not particularly limited, and therefore various forms can be used. Analog optical image forming apparatuses such as a static copy machine that uses halogen lamp as a white light source need a photoreceptor that has a sensitivity in a visible region, and therefore a perylene pigment, a bis-azo pigment or the like can be suitably applied thereto.

(Charge Transport Agent)

The charge transport agent is not particularly limited as long as it can be used as a charge transport agent included in a photosensitive layer of a single layer type electrophotographic photoreceptor. The charge transport agent is, generally, a hole transport agent or an electron generate agent.

The hole transport agent is not particularly limited as long as it can be used as a hole transport agent included in a photosensitive layer of a single layer type electrophotographic photoreceptor. Specific examples thereof include benzidine derivative, an oxadiazol compound such as 2,5-di (4-methylaminophenyl)-1,3,4-oxadiazol, a styryl compound such as 9-(4-diethylamino styryl)anthracene, a carbazole compound such as polyvinyl carbazole, an organic polysilane compound, a pyrazoline compound such as 1-phenyl-3-(p-dimethylamino phenyl)pyrazoline, a hydrazone compound, a triphenylamine compound, an indole compound, an oxazole compound, an isoxazole compound, a triazole compound, a thiadiazole compound, an imidazole compound, a pyrazole compound, a triazole compound and other nitrogen-containing cyclic compounds, as well as condensed polycyclic compounds. Above all, the triphenylamine compound is preferred, and triphenylamine compounds expressed by the following formulae (3) to (11) are particularly preferred.

[Chemical formula 3]

(3)

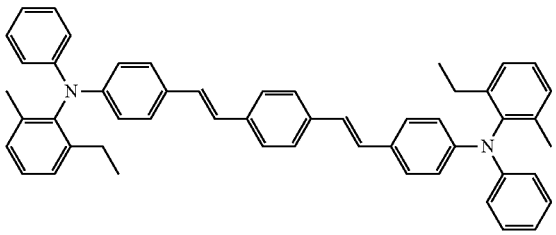

HTM-1

[Chemical formula 4]

(4)

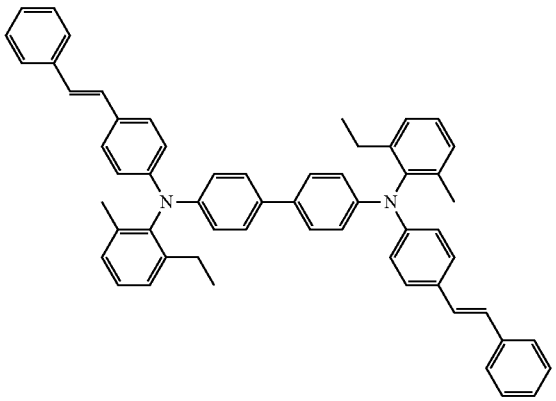

HTM-2

-continued
[Chemical formula 5]
(5)
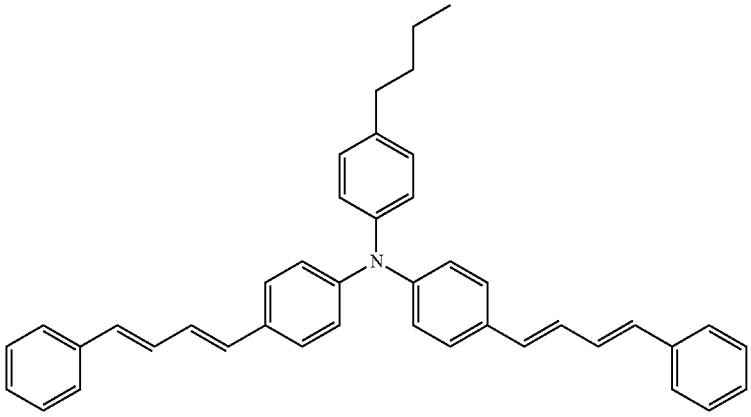
HTM-3
[Chemical formula 6]
(6)
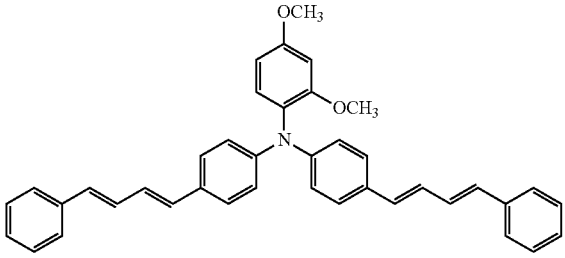
HTM-4
[Chemical formula 7]
(7)
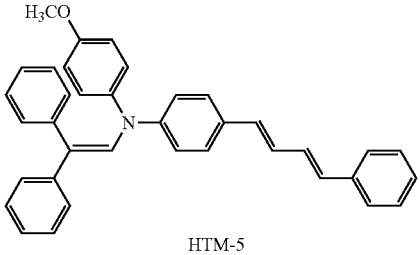
HTM-5
[Chemical formula 8]
(8)
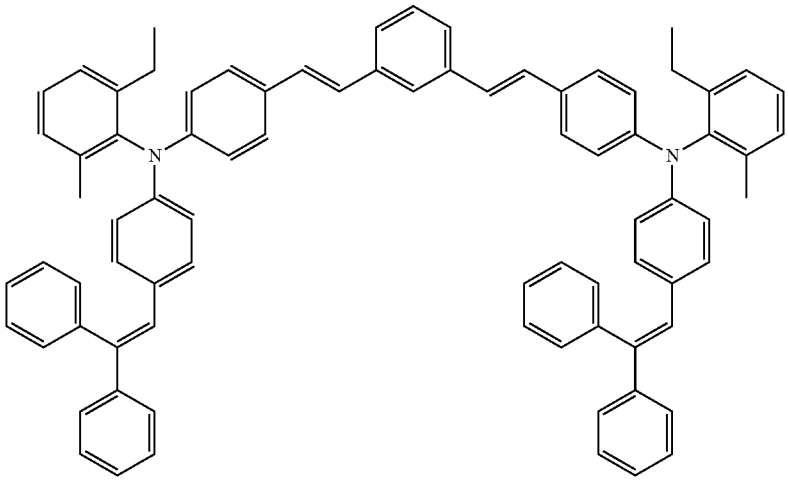
HTM-6

[Chemical formula 9]

(9)

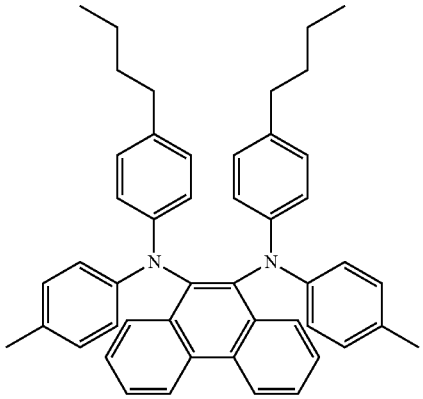

HTM-7

-continued

[Chemical formula 10]

(10)

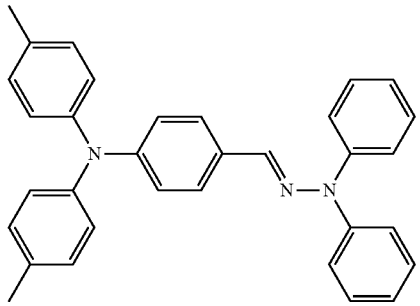

HTM-8

[Chemical formula 11]

(11)

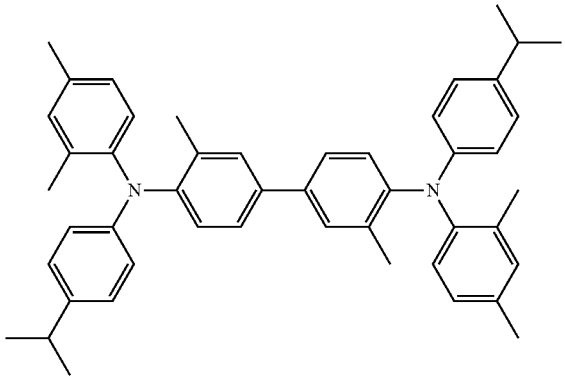

HTM-9

Each of these hole transport agents may be used alone, or a combination of two or more of these hole transport agents may be used.

The electron transport agent is not particularly limited as long as it can be used as an electron transport agent contained in a photosensitive layer of a single layer type electrophotographic photoreceptor. Specific examples of the electron transport agent include quinone derivatives such as naphthoquinone derivative, diphenoquinone derivative, anthraquinone derivative, azo-quinone derivative, nitroanthraquinone derivative and dinitroanthraquinone derivative, malononitrile derivative, thiopyran derivative, trinitrothioxanthone derivative, 3,4,5,7-tetranitro-9-fluorenone derivative, dinitroanthracene derivative, dinitroacridine derivative, tetracyanoethylene, 2,4,8-trinitrothioxanthone, dinitrobenzene, dinitroanthracene, dinitroacridine, succinic anhydride, maleic anhydride, and dibromo maleic anhydride. Above all, the quinone derivatives are preferred, and quinone derivatives expressed by the following formulae (12) to (14) are more preferred.

[Chemcial formula 12]

(12)

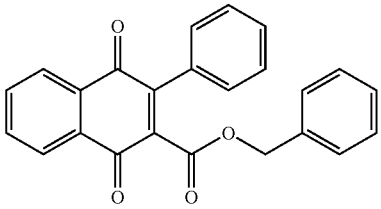

ETM-1

[Chemcial formula 13]

(13)

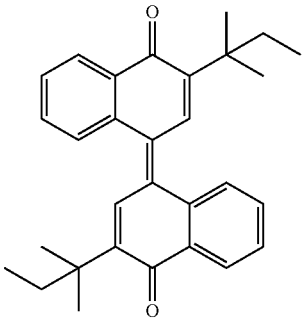

ETM-2

-continued

[Chemcial formula 14]

(14)

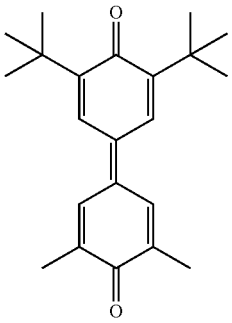

ETM-3

Each of these electron transport agents may be used alone, or a combination of two or more of these electron transport agents may be used.

(Binder Resin)

The binder resin is not particularly limited as long as it can be used as a binder resin of a single layer type electrophotographic photoreceptor. Preferably, the present embodiment uses a binder resin having a yield point strain of 9 to 29%. The peeling of the film of the photoreceptor can be prevented by using the binder resin having a yield point strain in this range. When the yield point strain is less than 9%, the film of the photoreceptor peels off easily. When, on the other hand, the yield point strain exceeds 29%, extraneous matters are formed on an image. It is considered that, as long as the yield point strain of the binder resin is within the range of 9 to 29%, the yield point strain of the photoreceptor surface layer falls within a range of 5 to 25%. Therefore, the abovementioned effects can be achieved by preparing such a photoreceptor in which the yield point strain of the photoreceptor surface layer falls within this range, but it is easy to adjust the yield point strain of the binder resin in the abovementioned range.

Any resins may be used as the binder resin as long as its yield point strain falls within the range of 9 to 29%. Examples of the binder resin include polycarbonate resin, polyester resin, and polyarylate resin. The polycarbonate resin is preferred in terms of its compatibility with the hole transport agent or the electron transport agent.

Examples of the polycarbonate resin include a polycarbonate resin having a recurring unit, such as the ones expressed by the following formulae (15) to (17).

[Chemical formula 15]

(15)

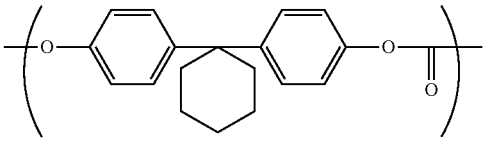

PC-Z

-continued

[Chemical formula 16]

(16)

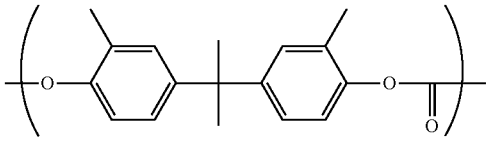

PC-C

[Chemical formula 17]

(17)

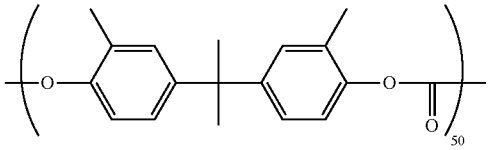

PC-C/PC-Z

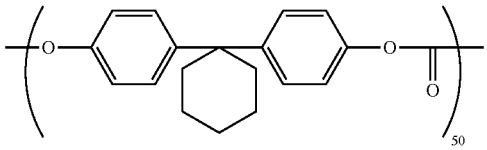

The number "50" in the formula (17) indicates that this binder resin is copolymerized at a copolymerization ratio of 50%. More specifically, the polycarbonate resin having a recurring unit that is expressed by the formula (17) is obtained by copolymerizing the recurring unit expressed by the formula (15) and the recurring unit expressed by the formula (16).

The number of recurring units in the polycarbonate resin is not particularly limited but is preferably such that it achieves the yield point strain of 9 to 29%.

In addition, when the polycarbonate resin is used as the binder resin, the viscosity-average molecular weight thereof is preferably 30,000 or higher, more preferably 40,000 to 80,000, or even more preferably 45,000 to 75,000. When the viscosity-average molecular weight of the polycarbonate resin is excessively low, the effect of improving the antiwear properties of the polycarbonate resin cannot be produced adequately, wearing the photosensitive layer out easily. On the other hand, when the viscosity-average molecular weight of the polycarbonate resin is excessively high, the polycarbonate resin cannot be dissolved in a solvent. This makes it difficult to prepare application liquid for forming the photosensitive layer and consequently to form an excellent photosensitive layer. Furthermore, extraneous matters are likely to be formed on an image.

The binder resin is preferably constituted by the polycarbonate resin but may contain a resin other than the polycarbonate resin. The resin other than the polycarbonate resin is not particularly limited as long as it can be used as the binder resin of the photosensitive layer. Specific examples of the resin include styrene resin, styrene-butadiene copolymer, styrene-acrylonitrile copolymer, styrene-maleic copolymer, styrene-acrylic copolymer, acrylic copolymer, polyethylene resin, ethylene-vinyl acetate copolymer, chlorinated polyethylene resin, polyvinyl chloride resin, polypropylene resin, ionomer, vinyl chloride-vinyl acetate copolymer, polyester resin, alkyd resin, polyamide resin, polyurethane resin, polycarbonate resin, polyarylate resin, polysulfone resin, diallyl phthalate resin, ketone resin, polyvinyl butyral resin, polyether resin and other thermoplastic resins, silicone resin, epoxy resin, phenol resin, urea resin, melamine resin and other crosslinkable thermosetting resins, epoxy acrylate resin, as well as urethane-acrylate copolymer resin and other photocrosslinkable resins.

(Additive)

The photoreceptor may contain various additives other than the charge generating agent, the charge transport agent and the binder resin, so as not to negatively affect the electrophotographic characteristics thereof. Specific examples of the additive include degradation inhibitors such as antioxidant, radical scavenger, singlet quencher and ultraviolet absorber, softener, plasticizer, surface modifier, extender, thickener, dispersion stabilizer, wax, acceptor, donor, surfactant, and leveling agent. In order to improve the sensitivity of the photosensitive layer, terphenyl, halo naphthoquinones, acenaphthylene, or other known sensitizer may be combined with the charge generating agent.

[Method for Producing Single Layer Type Photoreceptor]

A method for producing the single layer type photoreceptor is described next.

The single layer type photoreceptor can be produced by applying application liquid on the conductive substrate and drying the application liquid. The application liquid being obtained by dissolving or dispersing the charge generating agent, the charge transport agent, the binding resin, and, if necessary, various additives in a solvent. Although not particularly limited, the application method can be, for example, a dip coating method. The drying method can be, for example, a method for drying the application liquid using hot air at 80 to 150° C. for 15 to 120 minutes.

In the single layer type photoreceptor, the contents of the charge generating agent, the charge transport agent and the binder resin are selected appropriately and not particularly limited. Specifically, for example, the content of the charge generating agent is preferably 0.1 to 50 parts by mass or more preferably 0.5 to 30 parts by mass with respect to 100 parts by mass of the binder resin. The content of the electron transport agent is preferably 5 to 100 parts by mass or more preferably 10 to 80 parts by mass with respect to 100 parts by mass of the binder resin. The content of the hole transport agent is preferably 5 to 500 parts by mass or more preferably 25 to 200 parts by mass with respect to 100 parts by mass of the binder resin. The total quantity of the hole transport agent and the electron transport agent, which is the content of the charge transport agent, is preferably 20 to 500 parts by mass or more preferably 30 to 200 parts by mass with respect to 100 parts by mass of the binder resin. When containing an electron acceptable compound in the photosensitive layer, the content of the electron acceptable compound is preferably 0.1 to 40 parts by mass or preferably 0.5 to 20 parts by mass with respect to 100 parts by mass of the binder resin.

The thickness of the photosensitive layer of the single layer type photoreceptor is not particularly limited as long as it allows the photosensitive layer to function adequately. Specifically, for example, the thickness of the photosensitive layer is preferably 5 to 100 μm or more preferably 10 to 50 μm.

The solvent to be contained in the application liquid is not particularly limited as long each of the components described can be dissolved or dispersed in the solvent. Specific examples of the solvent include alcohols such as methanol, ethanol, isopropanol and butanol, aliphatic hydrocarbons such as n-hexane, octane and cyclohexane, aromatic hydrocarbons such as benzene, toluene and xylene, halogenated hydrocarbons such as dichloromethane, dichloroethane, carbon tetrachloride and chlorobenzene, ethers such as dimethyl ether, diethyl ether, tetrahydrofuran, ethylene glycol dimethyl ether and diethylene glycol dimethyl ether, ketones such as acetone, methyl ethyl ketone and cyclohexanone, esters such as ethyl acetate and methyl acetate, dimethylformaldehyde, dimethylformamide, and dimethylsulfoxide. Each of these solvents described above may be used alone, or a combination of two or more of these solvents may be used.

A method for creating the high-resistivity layer (interlayer) to be provided between the photosensitive layer and the conductive substrate is not particularly limited as long the method can form the high-resistivity layer on the conductive substrate. Specifically, for example, when the conductive substrate is an aluminum tube and the high-resistivity layer is an alumite layer, the method for creating the high-resistivity layer can be a method for anodizing the aluminum tube. More specifically, the method for creating the high-resistivity layer can be a method for performing the anodization by using sulfuric acid aqueous solution as electrolyte. In this case, the anodization time is preferably, for example, approximately 0.5 to 300 minutes. When using the sulfuric acid aqueous solution as the electrolyte, the concentration of the sulfuric acid aqueous solution is preferably, for example, approximately 0.1 to 80 mass %. Formation voltage used in the anodization is preferably, for example, approximately 10 to 200V.

(Image Forming Apparatus)

Although not particularly limited, the image forming apparatus according to the present embodiment is an electrophotographic image forming apparatus that has the positively-charged single layer type electrophotographic photoreceptor and the contact charging device. Specific examples of the image forming apparatus according to the present embodiment include a tandem type color image forming apparatus that uses a plurality of colors of toners, such as the one described specifically hereinbelow.

Note that the image forming apparatus having the electrophotographic photoreceptor according to the present embodiment has a plurality of photoreceptors that are arranged in a predetermined direction so as to form toner images using different toner colors on surfaces thereof, and a plurality of developing devices with developing rollers, which are disposed facing the respective photoreceptors, carry the toners on the surfaces of the developing rollers, and supply the toners to the respective surfaces of the photoreceptors.

Figure 3:
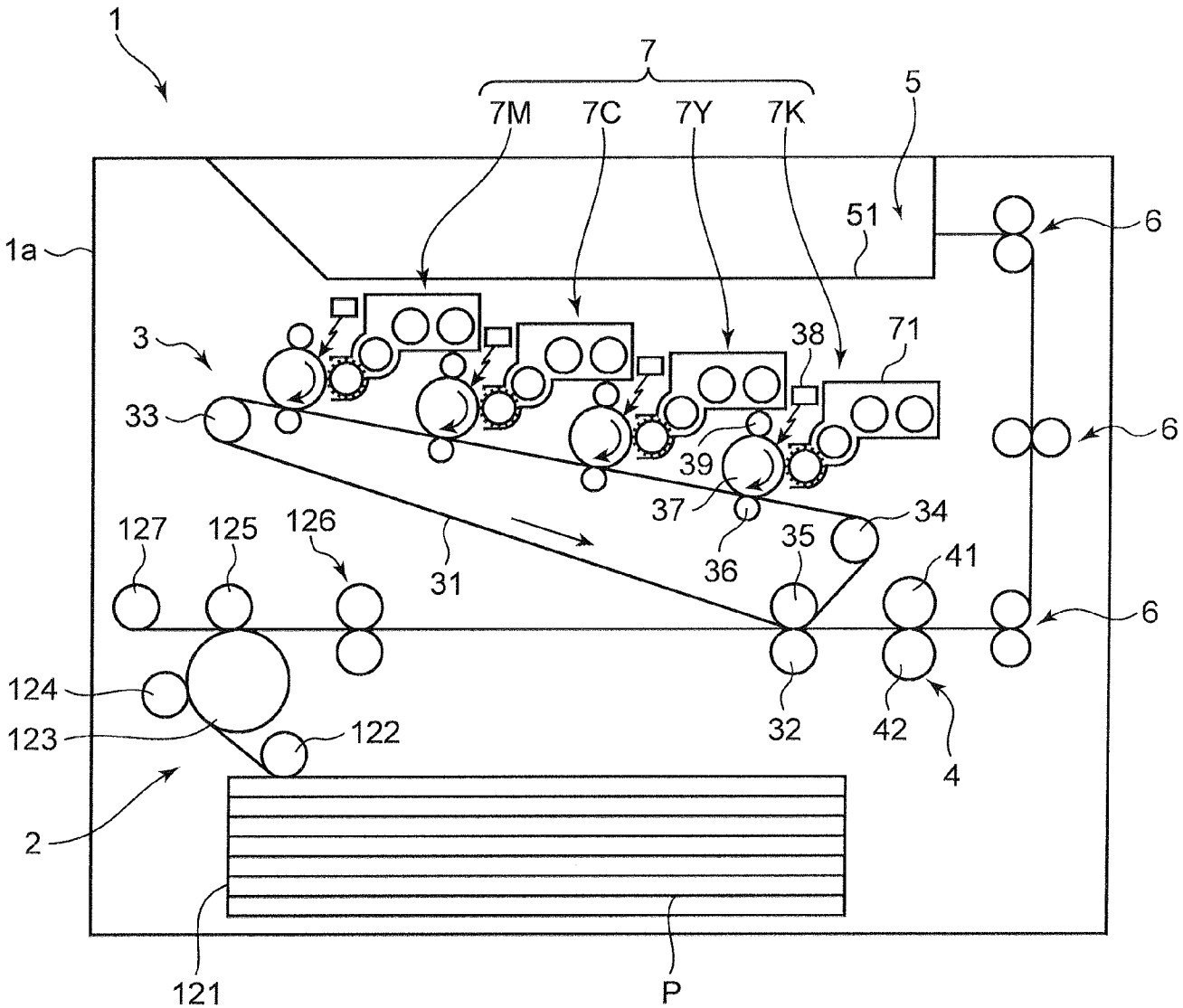
FIG. 3 is a schematic diagram showing a configuration of an image forming apparatus that has the positively-charged single layer type electrophotographic photoreceptor according to the embodiment of the present invention.

FIG. 3 is a schematic diagram showing a configuration of the image forming apparatus that has the positively-charged single layer type electrophotographic photoreceptor according to the embodiment of the present invention. In the description here, the image forming apparatus 1 is illustrated as a color printer 1.

As shown in FIG. 3, this color printer 1 has a box-shaped device main body 1*a*. The inside of the device main body 1*a* is provided with a sheet feeding part 2 for feeding sheets P, an image forming part 3 that transfers a toner image based on image data and the like to each of the sheet P while conveying the sheets P fed from the sheet feeding part 2, and a fixing part 4 that performs a fixing process for fixing the unfixed toner image onto each sheet P transferred by the image forming part 3. An upper surface of the device main body 1*a* is provided with a sheet ejection part 5 that ejects the sheets P subjected to the fixing process by the fixing part 4.

The sheet feeding part 2 has a paper cassette 121, a pickup roller 122, sheet feeding rollers 123, 124, 125, and resist rollers 126. The paper cassette 121 for storing the sheets P in different sizes is provided so as to be detachable from the device main body 1*a*. The pickup roller 122, provided in the upper left position of the paper cassette 121 in FIG. 3, picks up the sheets P of the paper cassette 121 one by one. The sheet feeding rollers 123, 124, 125 send the sheets P picked up by the pickup roller 122, to a sheet conveying path. The resist rollers 126 temporarily holds each of the sheets P, which are sent to the sheet conveying path by the sheet feeding rollers 123, 124, 125, and then supplies each sheet P to the image forming part 3 at a predetermined timing.

The sheet feeding part 2 further has a manual tray, not shown, which is installed on the left-hand side of the device main body 1*a* in FIG. 3, and a pickup roller 127. The pickup roller 127 picks up the sheets P placed on the manual tray. The sheets P picked up by the pickup roller 127 are sent to the sheet conveying path by the sheet feeding rollers 123, 125, and supplied to the image forming part 3 at a predetermined timing by the resist rollers 126.

The image forming part 3 has an image forming unit 7, an intermediate transfer belt 31, to a surface (contact surface) of which the toner image based on the image data is primarily transferred by the image forming unit 7, the image data being electronically transmitted from a computer or the like, and a secondary transfer roller 32 for secondarily transferring the toner image on the intermediate transfer belt 31 to each of the sheets P sent from the paper cassette 121.

The image forming unit 7 has a black unit 7K, yellow unit 7Y, cyan unit 7C and magenta unit 7M, which are disposed sequentially from an upstream (right-hand side in FIG. 3) toward a downstream. In a central position of each of the units 7K, 7Y, 7C and 7M, a photoreceptor drum 37 serving as an image carrier is disposed so as to be rotatable in a direction of an arrow (clockwise). A charging device 39, exposure device 38, developing device 71, cleaning device, not shown, and a destaticizer serving as destaticizing means are disposed sequentially from a rotational direction upstream around each of the photoreceptor drums 37. The electrophotographic photoreceptor described earlier is used as each photoreceptor drum 37.

The charging device 39 uniformly charges a circumferential surface of the corresponding photoreceptor 37 that rotates in the direction of the arrow. Contact charging devices (charging rollers) such as the one described earlier are used as the charging devices 39.

The exposure device 38, a so-called laser scanning unit, irradiates the corresponding circumferential surface of the photoreceptor drum 37, which is uniformly charged by the charging device 39, with a laser beam based on the image data that are input from a personal computer (PC), which is a host device, so as to form an electrostatic latent image based on the image data, on the photoreceptor drum 37. The developing device 71 forms the toner image based on the image data, by supplying the corresponding toner to the circumferential surface of the photoreceptor drum 37 on which the electrostatic latent image is formed. Then, the toner image is primarily transferred to the intermediate transfer belt 31. After completion of the primary transfer of the toner image to the intermediate transfer belt 31, the cleaning device cleans the toner remaining on the circumferential surface of the photoreceptor drum 37. After being cleaned by the cleaning device and the destaticizer, the circumferential surface of the photoreceptor drum 37 prepares for a new charging process performed by the charging device.

The intermediate transfer belt 31, an endless belt-like rotating body, is wrapped around a plurality of rollers such as a driving roller 33, driven roller 34, backup roller 35 and primary transfer rollers 36, in a manner that a surface (contact surface) of the intermediate transfer belt 31 abuts on the circumferential surface of each photoreceptor drum 37. The intermediate transfer belt 31 is also configured to be rotated endlessly by the plurality of rollers while being pressed against the photoreceptor drums 37 by the photoreceptor drums 37 and the primary transfer rollers 36. The driving roller 33 is driven to rotate by a drive source such as a stepping motor, to provide drive power for endlessly rotating the intermediate transfer belt 31. The driven roller 34, the backup roller 35 and the primary transfer rollers 36, provided rotatably, are rotated by the endless rotation of the intermediate transfer belt 31. These rollers 34, 35, 36 are rotated following the main rotation of the driving roller 33, via the intermediate transfer belt 31, and support the intermediate transfer belt 31.

The primary transfer roller 36 applies a primary transfer bias (having a polarity opposite a toner charging polarity) to the intermediate transfer belt 31. Accordingly, the toner images formed on the photoreceptor drums 37 are superimposed sequentially (primary transfer) on the intermediate transfer belt 31 that revolve between the photoreceptor drums 37 and the primary transfer rollers 36 in a direction of an arrow (counterclockwise) by means of the drive of the driving roller 33.

The secondary transfer roller 32 applies a secondary transfer bias having a polarity opposite the polarity of the toner images to each of the sheets P. Accordingly, the toner images that are primarily transferred onto the intermediate transfer belt 31 are transferred to each of the sheets P between the secondary transfer roller 32 and the backup roller 35. As a result, a color transfer image (unfixed toner images) is transferred to each of the sheets P.

The fixing part 4 performs the fixing process on the image transferred onto each sheet P by the image forming part 3. The fixing part 4 has a heat roller 41 heated by an electric heat generating body, and a pressure roller 42, which is disposed facing the heat roller 41 and a circumferential surface of which comes into press contact with a circumferential surface of the heat roller 41.

The image transferred to each sheet P by the secondary transfer roller 32 in the image forming part 3 is fixed to the sheet P by the fixing process that uses heat generated as the sheet P passes between the heat roller 41 and the pressure roller 42. After the fixing process, the sheet P is ejected to the sheet ejection part 5. In addition, in the color printer 1 of the present embodiment, conveying rollers 6 are disposed in appropriate places between the fixing part 4 and the sheet ejection part 5.

The sheet ejection part 5 is formed into a concave shape at a top part of the device main body la of the color printer 1. A catch tray 51 for receiving the ejected sheets P is formed at a bottom part of this concave part.

The image forming apparatus 1 forms images on the sheets P by the following image formation operations. Because the tandem type image forming apparatus described above has the charging rollers as the charging devices and the photoreceptors as image carriers, suitable images can be formed even with a combination of the contact time charging devices and the positively-charged single layer type electrophotographic photoreceptors. Therefore, an image forming apparatus with extremely high durability that has resistant photosensitive layers can be obtained.

According to the present invention, the image forming apparatus that has the long-lasting positively-charged single layer type photoreceptors and the charging rollers capable of reducing the amount of ozone, can resolve the conventional problems such as uneven charging, wear of the photoreceptors, peeling of the films of the photoreceptors, and carrier trapping, increasing the life-spans of the photoreceptors. In other words, the image forming apparatus of the present invention is an apparatus that accomplishes excellent durability that generates less ozone, and is extremely useful in terms of environmental responsiveness and industrial applicability.

EXAMPLES

The present invention is described hereinafter more specifically using examples, but the present invention is not at all limited to these examples.

Experimental Example 1

Hardness of the Charging Rollers

Example 1

(Photoreceptors)

The charge generating agent (metal-free naphthalocyanine expressed by the formula (1) described above) in an amount of 5 parts by mass, the hole transport agent (HTM-3, expressed by the chemical formula (5) described above) in an amount of 50 parts by mass, the electron transfer agent (ETM-2, expressed by the chemical formula (13) described above) in an amount of 35 parts by mass, and the binder resin (viscosity-average molecular weight is 67000), expressed by the chemical formula (15) described above, in an amount of 100 parts by mass were mixed and dispersed in 800 parts by mass of tetrahydrofuran using a ball mill for 50 hours, to prepare photoreceptor application liquid. This application liquid was applied onto the conductive substrate by means of the dip coating method. Thereafter, the conductive substrate with the application liquid thereon was dried by hot air at 100° C. for 40 minutes, to obtain a photoreceptor having a film thickness of 30 μm (diameter is 30 mm).

(Charging Devices)

A charging roller in which a conductive rubber layer has a hardness of 71°, diameter of 12 mm, and thickness of 2 mm (manufactured by Tokai Rubber Industries, Ltd.) was used, the conductive rubber layer being made of rubber having epichlorohydrin rubber as the main ingredient.

The photoreceptors and the charging devices were provided to FS-C5300DN (A4 color printer) manufactured by Kyocera Mita Japan Corporation to obtain a modified image forming apparatus. Note that the rubber hardness of each charging roller was measured by directly pressing an Asker rubber hardness tester C (manufactured by Kobunshi Keiki Co., Ltd.) against the charging roller by using a constant pressure load instrument manufactured by the same company.

Comparative Example 1

Other than the fact that charging roller that is made of epichlorohydrin rubber (manufactured by Tokai Rubber Industries, Ltd.) having a hardness of 82° is used as each of the charging rollers, the image forming apparatus was obtained in the same manner as Example 1.

[Evaluation]

The following evaluation tests were carried out using the image forming apparatus described above.

(Charging Ability)

Figure 4:
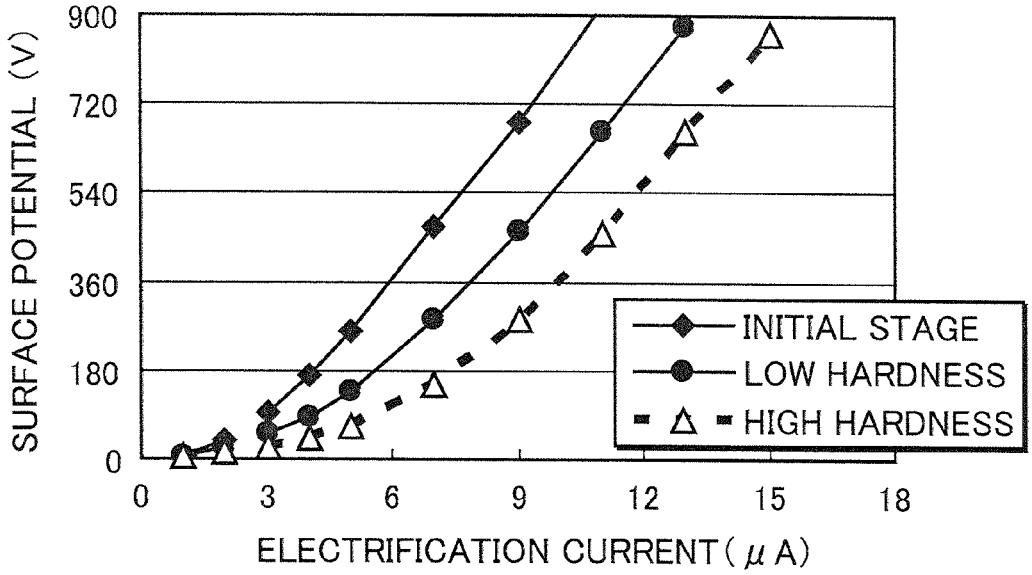
FIG. 4 is a graph illustrating the charging abilities obtained in experimental example 1.

A high-voltage power supply model 610B, manufactured by TREK Corporation, was connected to each charging roller to apply a voltage of 0 to 2000 V to the charging roller. The potential on the surface of each photoreceptor and current (electrification current) flowing to each charging roller were measured. The potential on the surface of the photoreceptor was measured using a surface electrometer model 344 manufactured by TREK Corporation. The current was measured by connecting small portable ammeters 2051 of Yokogawa Meters & Instruments Corporation in series between a DC power and each charging roller. The DC power was controlled to provide constant voltage. The results are shown in FIG. 4.

(Surface Potential)

Figure 5:
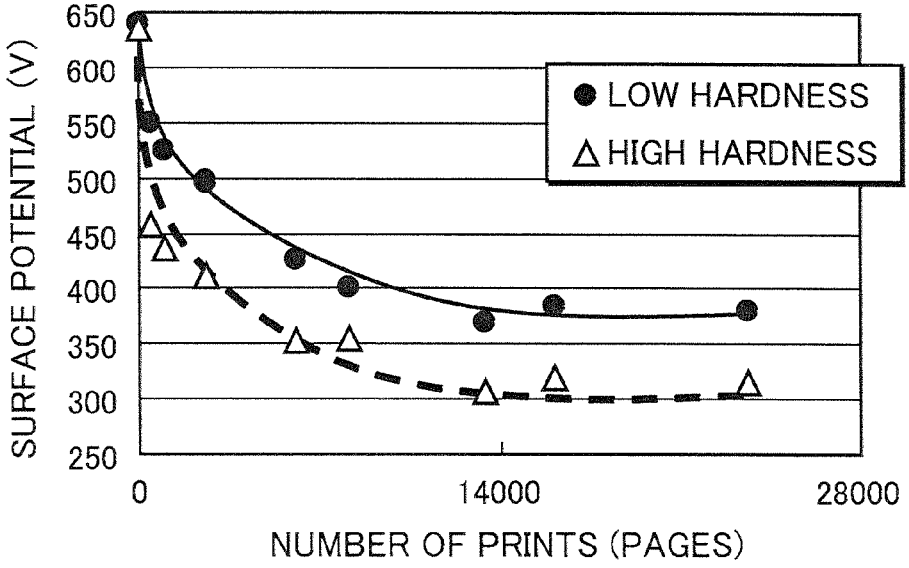
FIG. 5 is a graph illustrating surface potentials obtained in experimental example 1.

Original document was printed out continuously on A4-size transfer sheets at a printing ratio of 4%, to periodically measure the surface potential of each photoreceptor. In so doing, the voltage applied to each charging roller was adjusted so that the initial surface potential is approximately 650 V. Changes in the surface potentials were observed without changing the applied voltage after the adjustment. The results are shown in FIG. 5.

(Rate of Peeling of Drum Films)

Figure 6:
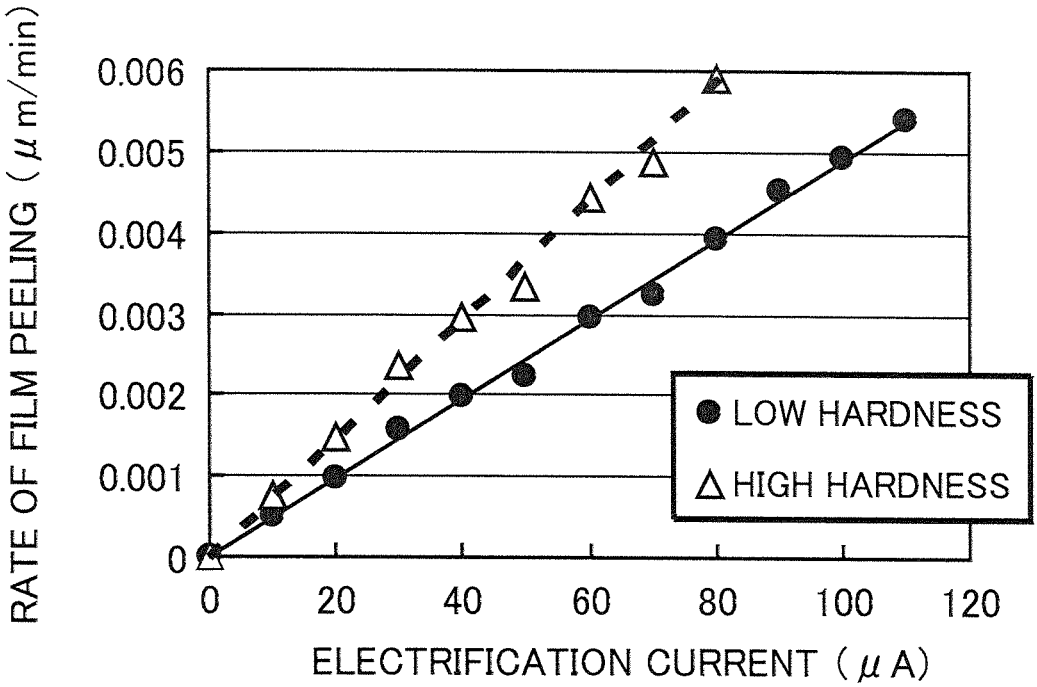
FIG. 6 is a graph illustrating peeling of a film of a photoreceptor drum resulted in experimental example 1.

The photoreceptors were rotated while conducting a fixed current to the charging rollers. The degree of peeling of the film of each photoreceptor was measured after 10 hours. This test was performed for each current value of the charging rollers to measure the degree of peeling. The thickness of each film was measured using MMS 3AM manufactured by Fischer Instruments. The results are shown in FIG. 6.

Experimental Example 2

Surface Roughness of Charging Rollers

FS-C5300DN (A4 color printer) manufactured by Kyocera Mita Japan Corporation was used as an experimental machine to obtain a modified image forming apparatus, the FS-C5300DN having the same photoreceptors as those obtained in Example 1, and charging rollers (made of epichlorohydrin rubber, having a conductive rubber layer with a diameter of 12 mm and thickness of 2 mm, manufactured by Tokai Rubber Industries, Ltd.), the hardness and surface roughness (average distance (Sm) between asperity peaks on a cross-sectional curve and ten-point average roughness (Rz)) of which were changed as shown in the following Table 1 (image forming apparatuses obtained examples 2 to 12 and comparative examples 2 to 14 show the results in accordance with the average distance (Sm) between asperity peaks on a cross-sectional curve and the ten-point average roughness (Rz)).

Note that the average distance (Sm) between asperity peaks on a cross-sectional curve and the ten-point average roughness (Rz) were measured using SURFCOM 1500DX manufactured by Tokyo Seimitsu Co., Ltd. The roughness was analyzed based on JIS B 0601-1994 standard. In examples 2 to 6 and comparative examples 2 to 8 the Rz values were fixed to 10 μm, and in examples 7 to 12 and comparative examples 8 to 15 the Sm values were fixed to 100 μm.

Subsequently, these image forming apparatuses (examples 2 to 12 and comparative examples 2 to 14) were used to check uneven charging on the images when printing 20 pages using an electrification voltage of 1.2 KVdc (surface potential 400 V). The test room used was in a low-humidity environment of 10° C./15% RH (since uneven charging is likely to occur more often under low temperatures). When the uneven charging was observed, the result was marked as "x." When the uneven charging was not observed, the result was marked as "O." The results are shown in Table 1, FIG. 7 (the average distance (Sm) between asperity peaks on a cross-sectional curve and hardness), and FIG. 8 (the ten-point average roughness (Rz) and hardness).

TABLE 1

| | Hardness (Asker C) | Surface roughness | Uneven charging |
|---|---|---|---|
| Example 2 | 68 | Sm: 130 | ○ |
| Example 3 | 69 | Sm: 98 | ○ |
| Example 4 | 65 | Sm: 55 | ○ |
| Example 5 | 77 | Sm: 115 | ○ |
| Example 6 | 75 | Sm: 60 | ○ |
| Comparative Example 2 | 67 | Sm: 250 | x |
| Comparative Example 3 | 75 | Sm: 200 | x |
| Comparative Example 4 | 82 | Sm: 74 | x |
| Comparative Example 5 | 88 | Sm: 160 | x |
| Comparative Example 6 | 92 | Sm: 200 | x |
| Comparative Example 7 | 95 | Sm: 50 | x |
| Comparative Example 8 | 68 | Sm: 35 | x |
| Example 7 | 62 | Rz: 10 | ○ |
| Example 8 | 73 | Rz: 9 | ○ |
| Example 9 | 70 | Rz: 12 | ○ |
| Example 10 | 62 | Rz: 18 | ○ |
| Example 11 | 78 | Rz: 19 | ○ |
| Example 12 | 81 | Rz: 15 | ○ |
| Comparative Example 8 | 65 | Rz: 28 | x |
| Comparative Example 9 | 75 | Rz: 30 | x |
| Comparative Example 10 | 82 | Rz: 23 | x |
| Comparative Example 11 | 87 | Rz: 21 | x |
| Comparative Example 12 | 90 | Rz: 12 | x |
| Comparative Example 13 | 86 | Rz: 10 | x |
| Comparative Example 14 | 90 | Rz: 30 | x |
| Comparative Example 15 | 70 | Rz: 30 | x |

Experimental Test 3 (Yield Point Strain of the Photoreceptors)

(Method for Manufacturing the Photoreceptors)

The charge generating agent (metal-free naphthalocyanine expressed by the formula (1) described above) in an amount of 5 parts by mass, the hole transport agent (HTM-3, expressed by the chemical formula (5) described above) in an amount of 50 parts by mass, the electron transfer agent (ETM-2, expressed by the chemical formula (13) described above) in an amount of 35 parts by mass, and each binder resin, expressed by the following Table 2, in an amount of 100 parts by mass were mixed and dispersed in 800 parts by mass of tetrahydrofuran using a ball mill for 50 hours, to prepare photoreceptor application liquid. This application liquid was applied onto the conductive substrate by means of the dip coating method. Thereafter, the conductive substrate with the application liquid thereon was dried by hot air at 100° C. for 40 minutes, to obtain a photoreceptor having a film thickness of 30 μm (diameter is 30 mm).

The binder resins shown in Table 2 are as follows:

"PC-Z": Resin expressed by the chemical formula (15) described above.

"PC-C": Resin expressed by the chemical formula (16) described above.

"PC-C/PC-Z": Resin expressed by the chemical formula (17) described above.

(Evaluation)

The yield point strain of each photoreceptor surface layer and each binder resin was measured using a viscoelasticity measuring instrument ("DMA-Q800," manufactured by TA Instruments) under the following evaluation conditions.

Initial load: 1 N

Measurement temperature: 30° C.

Strain rate: 0.5%/minute (Sampling interval: every 2 seconds)

Next, the prepared photoreceptors (examples 13 to 15 and comparative examples 16 to 18 in accordance with the contained binder resins) were mounted in a printer FS-1300D, manufactured by Kyocera Mita Japan Corporation, and a printing test was carried out no 50,000 pages, to evaluate the degree of peeling of the photosensitive layers (μm). Through this image evaluation, formation of extraneous matters was evaluated.

Figure 9:
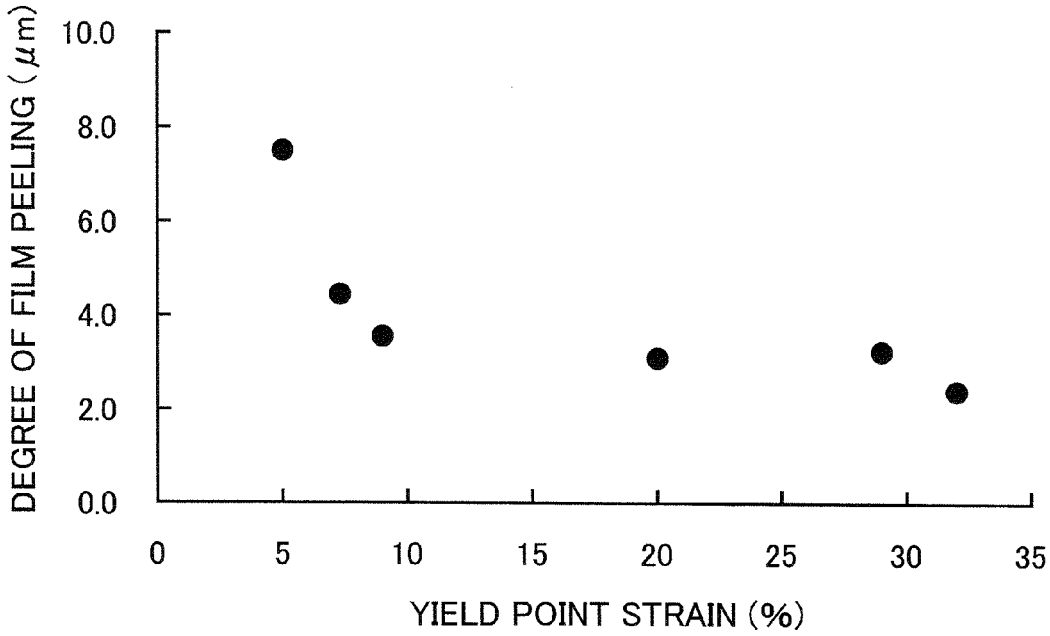
FIG. 9 is a graph illustrating a relationship between a degree of peeling of the film of the photoreceptor and a yield point strain of a binder resin contained in the photoreceptor in experimental example 3.

The results are shown in Table 2. FIG. 9 shows a relationship between the degree of peeling of the film of each photoreceptor and the yield point strain of each binder resin contained in each photoreceptor.

TABLE 2

| | Resin type | Molecular weight mw | Yield point strain % Photoreceptors | Yield point strain % resins | Degree of peeling | Evaluation on formation of extraneous matters |
|---|---|---|---|---|---|---|
| Example 13 | PC-Z | 75000 | 23 | 29.0 | 3.25 | No |
| Example 14 | PC-Z | 67000 | 14 | 20.0 | 3.10 | No |
| Example 15 | PC-C/PC-Z | 55000 | 7.1 | 9.0 | 3.52 | No |
| Comparative Example 16 | PC-Z | 30000 | 2.94 | 7.3 | 4.56 | No |
| Comparative Example 17 | PC-C | 48000 | 2.4 | 5.0 | 7.48 | No |
| Comparative Example 18 | PC-Z | 80000 | 27 | 32 | 2.40 | Yes |

[Discussions]

As is clear from FIGS. 4 to 6, use of the low-hardness charging rollers produced better charging ability than high-hardness charging rollers (FIG. 4) and low surface potentials even after printing out 20,000 pages (FIG. 5). As a result, peeling of the film of each photoreceptor drum was reduced (FIG. 6).

Figure 7:
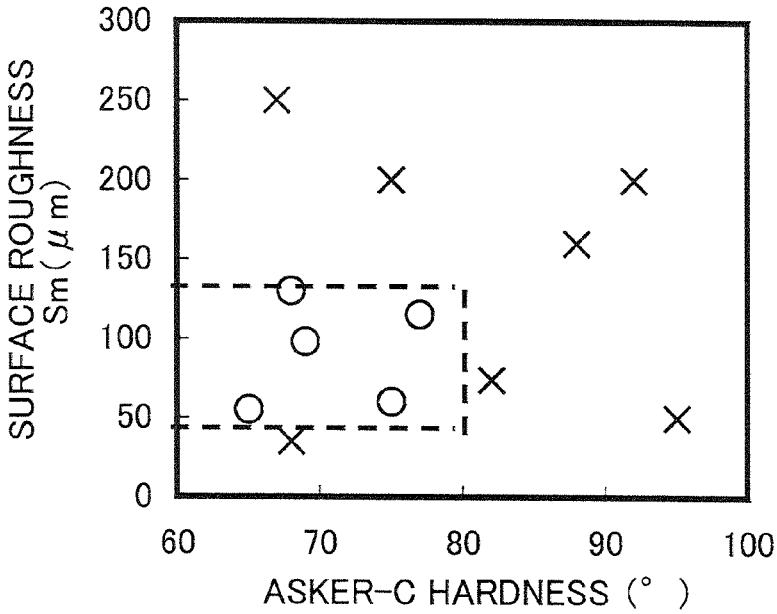
FIG. 7 is a graph illustrating uneven roughness caused by a difference in surface roughness (average distance (Sm) between asperity peaks on a cross-sectional curve) in experimental example 2.
Figure 8:
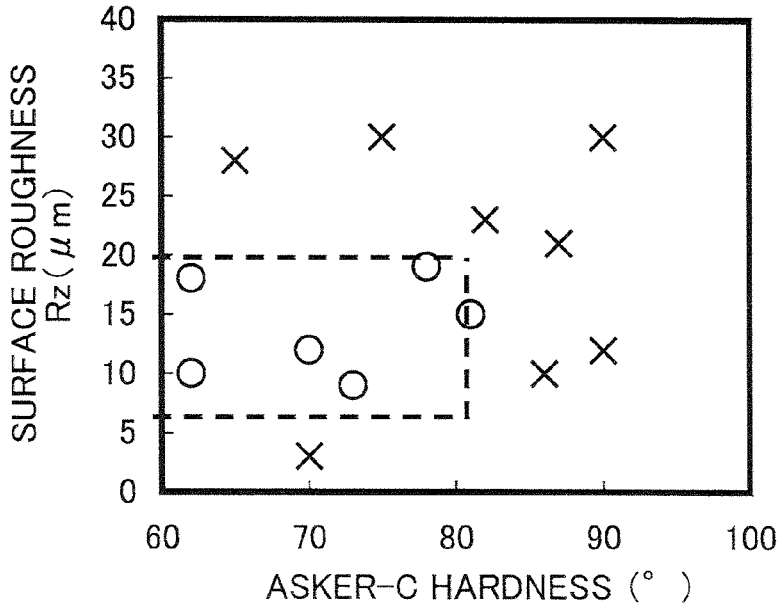
FIG. 8 is a graph illustrating uneven charging caused by a difference in surface roughness (ten-point average roughness (Rz)) in experimental example 2.

In addition, as is clear from Table 1 and FIGS. 7 and 8, the requirements of having low hardness and specific ranges of the surface roughness of the charging rollers did not cause uneven charging (examples 2 to 6 and 7 to 12). On the other hand, uneven charging occurred when the surface roughness was outside the specific ranges (comparative examples 2 to 6, 8 to 11, 14 and 15). However, when the hardness of the charging rollers was high, uneven charging occurred even when the surface roughness was within the specific ranges (comparative examples 7, 12 and 13). Therefore, it was found out that the hardness of the charging rollers does show some effects on uneven charging.

The results showed that excellent charging ability can be obtained and the peeling of the film of each photoreceptor and uneven charging can be prevented as long as the hardness and surface roughness of the charging rollers are within the ranges described in the present invention.

In addition, as shown in Table 2 and FIG. 9, use of the photoreceptors that contain the binder resins having a yield point strain of 9 to 29% (the yield point strain of each photoreceptor surface layer is 5 to 25%) can prevent the peeling of the film of each photoreceptor and formation of extraneous matters on formed images.

The results described above shows that the present invention can obtain a long-lasting, environmentally responsive image forming apparatus that produces less ozone and is capable of solving various conventional problems of an image forming apparatus having a positively-charged single layer type photoreceptor and contact charging device.

This application is based on Japanese Patent application Nos. 2010-129123 and 2010-289757 filed in Japan Patent Office on Jun. 4, 2010 and Dec. 27, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a positively-charged single layer type electrophotographic photoreceptor;

a charging device that has a contact charging member for charging a surface of the photoreceptor;

an exposure device for exposing the charged surface of the photoreceptor to light to form an electrostatic latent image on the surface of the photoreceptor;

a developing device for developing the electrostatic latent image into a toner image; and a transfer device for transferring the toner image from the photoreceptor to a transferred body, wherein the contact charging member is a charging roller, which is made of electrically conductive rubber having an Asker-C rubber hardness of 62 to 81°, and a roller surface roughness of the charging roller of the contact charging member is such that an average distance (Sm) between asperity peaks on a cross-sectional curve is 55 to 130 μm and that a ten-point average roughness (Rz) is 9 to 19 μm, the positively-charged single layer type electrophotographic photoreceptor has a conductive substrate and a photosensitive layer, the photosensitive layer contains a charge generating agent, charge transfer agent and binder resin together, a yield point strain of the binder resin is 9 to 29%, and the binder resin is a polycarbonate resin having a viscosity-average molecular weight of 45,000 to 75,000 and a recurring unit expressed by one of the formulae (15) to (17):

[Chemical formula 15]

(15)

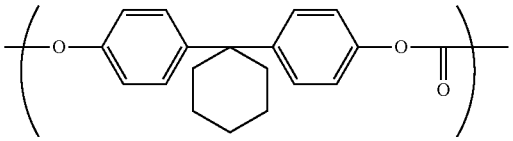

PC-Z

[Chemical formula 16]

(16)

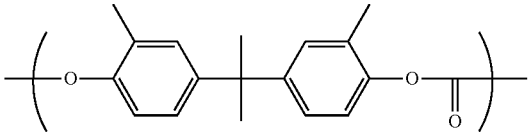

PC-C

[Chemical formula 17]

(17)

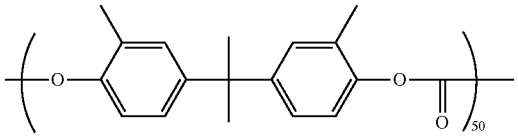

PC-C/

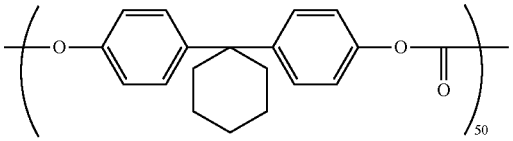

PC-Z wherein the number "50" in the formula (17) indicates that the binder resin of the formula (17) is copolymerized at a copolymerization ratio of 50%.

2. The image forming apparatus according to claim 1, wherein the charging device applies only a DC voltage to the charging roller.

* * * * *